US006353931B1

(12) United States Patent
Gilligan et al.

(10) Patent No.: US 6,353,931 B1
(45) Date of Patent: Mar. 12, 2002

(54) BASEBALL MITT

(75) Inventors: Lawrence Joseph Gilligan; Joseph Francis Gilligan, both of Ringwood, NJ (US)

(73) Assignee: Akadema Inc., Garfield, NJ (US)

( * ) Notice: Subject to any disclaimer, the term of this patent is extended or adjusted under 35 U.S.C. 154(b) by 0 days.

(21) Appl. No.: 09/767,464

(22) Filed: Jan. 23, 2001

(51) Int. Cl.[7] ..... A41D 13/08
(52) U.S. Cl. ..... 2/19
(58) Field of Search ..... 2/16, 19, 20, 161.1

(56) References Cited

U.S. PATENT DOCUMENTS

| | | | | | |
|---|---|---|---|---|---|
| D112,819 | S | | 1/1939 | Turner | |
| 2,434,171 | A | * | 1/1948 | Latina | 2/19 |
| 2,473,025 | A | * | 6/1949 | Gregg | 2/19 |
| 2,485,882 | A | * | 10/1949 | Hilton | 2/19 |
| 2,558,544 | A | * | 6/1951 | Delsalle | 2/19 |
| D187,518 | S | | 3/1960 | Latina | D3/11 |
| 3,051,958 | A | | 9/1962 | Latina | 2/19 |
| 3,169,250 | A | | 2/1965 | Heiman | 2/19 |
| 3,300,787 | A | | 1/1967 | Denkert | 2/19 |
| 4,279,681 | A | | 7/1981 | Klimezky | 156/245 |
| 4,346,481 | A | | 8/1982 | Latina | 2/19 |
| D325,795 | S | | 4/1992 | Labitan | D29/21 |
| 5,435,008 | A | * | 7/1995 | Shane | 2/19 |
| 5,572,739 | A | | 11/1996 | Kolada et al. | 2/19 |
| 5,592,688 | A | * | 1/1997 | LaRonge et al. | 2/19 |
| 5,687,421 | A | | 11/1997 | Murai | 2/19 |
| 5,706,519 | A | | 1/1998 | Cooper | 2/19 |

* cited by examiner

*Primary Examiner*—John J. Calvert
*Assistant Examiner*—Gary L. Welch
(74) *Attorney, Agent, or Firm*—Moser, Patterson & Sheridan, LLP

(57) ABSTRACT

A baseball mitt for fielding ground balls. The baseball mitt comprises a front shell having a unitary planar finger portion terminating with four fingertips, and a palm portion positioned below and coextensive with the planar finger portion. A thumb portion extends from the palm portion and adjacent to the planar finger portion, and a heel portion is positioned below and coextensive with the palm portion and the thumb portion. A web is disposed between the thumb portion and the planar finger portion. Additionally, a back shell covers the front shell and front and back shells are attached to one another about a peripheral edge of the respective shells.

20 Claims, 7 Drawing Sheets

BASEBALL MITT

BACKGROUND OF THE DISCLOSURE

1. Field of Invention

The present invention relates generally to a baseball mitt. More specifically, the invention relates to a baseball mitt having a substantially planar finger portion.

2. Description of the Background Art

A baseball player, such as a second baseman, shortstop, or third baseman defends the infield of a baseball field, in part, by fielding pop flies, line drives, and ground balls. When a ground ball is fielded, the player (i.e., infielder) usually catches the ball with the gloved hand, transfers the ball to the throwing hand, and then make a throw to the baseman that a hitter is running towards. As such, time is of the essence when fielding the ball and thereafter relaying the ball to the target base, before the base runner arrives.

A conventional baseball glove has a palm portion, a web portion, and five independent finger portions including a thumb portion. The web portion is located between the forefinger and thumb portions, such that the shape of the glove as between the forefinger, web and thumb is concave. As such, the baseball is easily trapped in the web portion.

If the infielder fields a ground ball with the web portion of the conventional glove, the infielder must retrieve the ball out of the web. In some instances, the baseball tends to stick in the web as the infielder tries to grasp the ball, which often leads to an untimely throw to another base.

As such, a skilled infielder, such as a collegian or professional ball player, will preferably field the ball by using the finger area of the glove in an attempt to stop the ball, and then let the ball come to rest in the palm of the glove. However, as the glove is used during the season, the leather and laces stretch, thereby causing the surface area of the fingers to become contoured with numerous depressions and protrusions of varying heights relative to each other. The varying heights and random contours over the surface area of the fingers and palm increase the susceptibility of the ball to bounce over the finger and palm area of the glove while the infielder tries to secure the ball. Accordingly, precious time is lost when the infielder tries to retrieve the ball from the gloved hand with the throwing hand.

Moreover, the fingers are typically laced between the fingertips on the palm side of the glove. As such, the fingers are prone to curl inwards, similar to the player's hand when held in a relaxed position. When the fingers curl inward, the contoured surface areas of the fingers are further increased, thereby decreasing the overall surface area of the fingers available for fielding the ball. As such, many infielders are forced to repeatedly bend the fingertips backward in an attempt to temporarily flatten the palm side of the glove. However, the fingertips quickly return to their natural curled in state. Furthermore, the little finger portion of the glove also tends to curl in towards the thumb. As such, the glove tends to stay in a slightly closed position, thereby losing valuable surface area for fielding a ground ball.

Therefore, there is a need for a mitt that permits an infielder to successfully stop ground balls, as well as retrieve the ball from the mitt with the throwing hand in a minimal amount of time.

SUMMARY OF INVENTION

The disadvantages associated with the prior art are overcome by the present invention of a baseball mitt having a planar finger portion. More specifically, the baseball mitt comprises a front shell having a unitary planar finger portion terminating with four fingertips. A palm portion is positioned below and coextensive with the planar finger portion. A thumb portion extends from the palm portion and adjacent to the planar finger portion, and a heel portion is positioned below and coextensive with the palm portion and the thumb portion.

A web is disposed between the thumb portion and the planar finger portion. Additionally, a back shell covers the front shell and is attached about a peripheral edge of the front shell and back shell.

The planar finger portion is substantially flat such that a forefinger portion, middle finger portion, ring finger portion, and little finger portion are substantially aligned with one another. A three-finger padding layer is positioned proximate the forefinger portion, middle finger portion, and ring finger portion, and is compressible upon impact of a baseball. A little finger padding layer having a thickness greater than the three-finger padding layer is disposed proximate the little finger portion. As such, a fielded ground ball will be stopped by the planar finger portion and channeled to the palm portion, as opposed to being trapped in the web.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical element, which are common to the figures.

DETAIL DESCRIPTION OF INVENTION

The present invention is generally a baseball mitt, and more specifically, an infielder's mitt having an inventive pocket area for fielding ground balls. The figures and description are illustratively depicted and discussed as a left-handed mitt, however one skilled in the art will recognize that a right-handed mitt is also contemplated by the invention.

Figure 1:
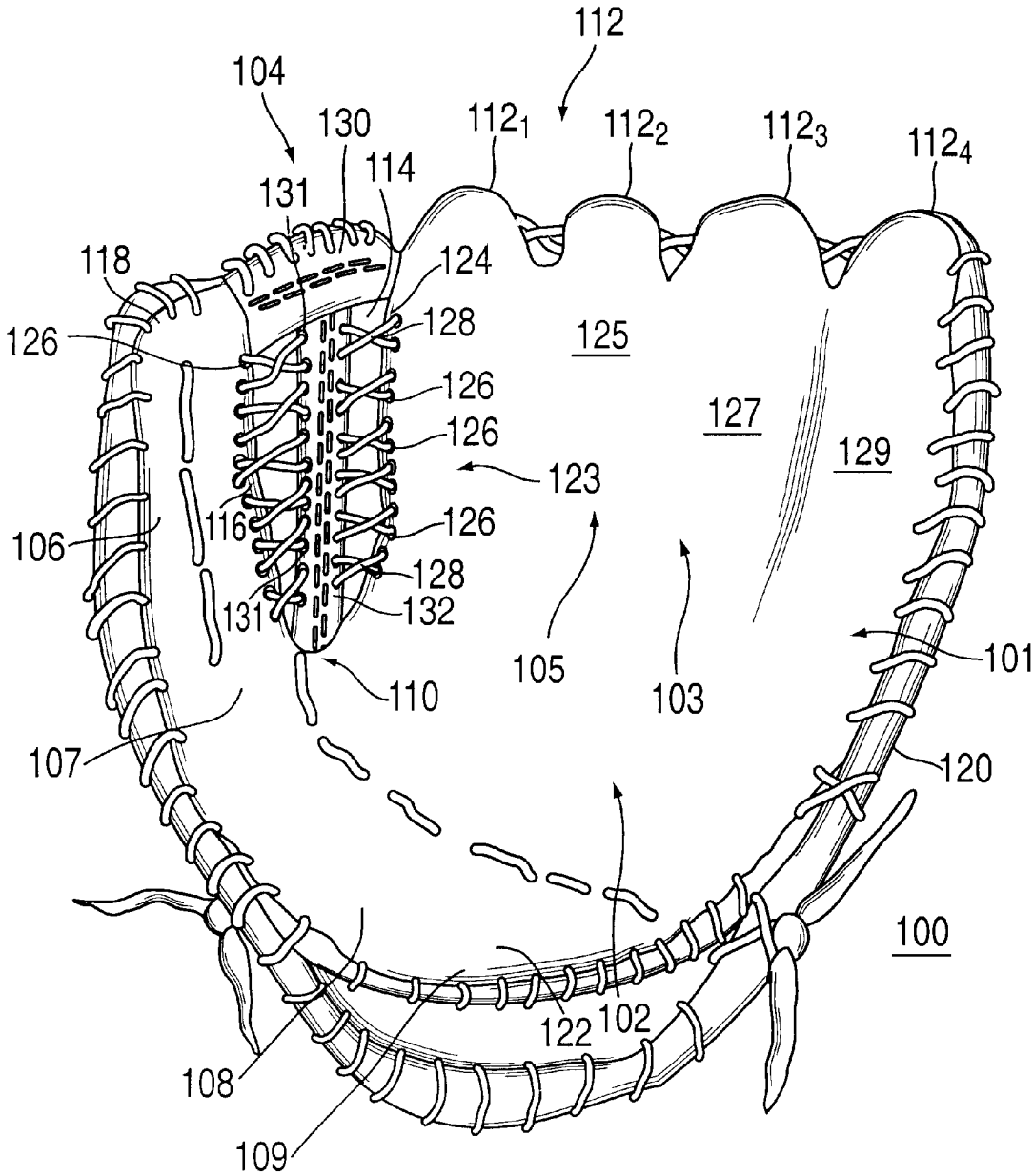
FIG. 1 depicts a front view of a fielder's mitt embodying features of the present invention.
Figure 2:
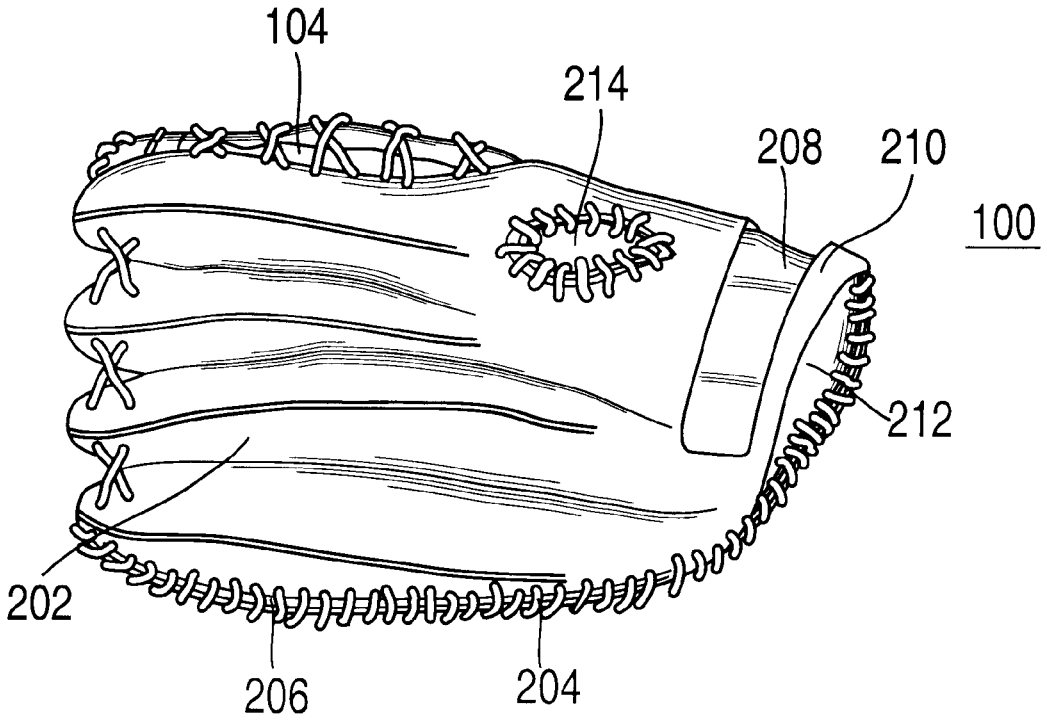
FIG. 2 depicts a rear view of the fielder's mitt of FIG. 1.

FIG. 1 depicts a front view of an infielder's mitt 100 embodying features of the present invention. FIG. 2 depicts a rear view of the fielder's mitt of FIG. 1. For purposes of better understanding the invention, FIGS. 1 and 2 should be viewed together. The mitt 100 comprises a front shell 101, a back shell 202 (see FIG. 2), and a web portion 104. The front shell 101, web 104, and back shell 202 are fabricated preferably from leather, or some other pliable material such as plastic, and is generally shaped as an oversized human hand.

The front shell 101 is a single ply of material comprising a palm portion 102, a heel portion 108, a planar finger portion 103, and a thumb portion 106. The various portions of the front shell 101 characteristically mimic the physical characteristics and nomenclature of the human hand. In particular, the planar finger portion 103 is a planar unitary area that covers the four fingers of a fielder's hand similar to a mitten, as opposed to a glove having independent fingers. The planar finger portion 103 comprises a forefinger portion 123, a middle finger portion 125, a ring finger portion 127, and a little finger portion 129 signifying where the fielders fingers are disposed in the mitt 100. In addition, the finger portions 123, 125, 127, and 129 respectively terminate at corresponding fingertips 1121 through 1124 (collectively fingertips 112)

The palm portion 102 is disposed below the finger portion 103 and above the heel portion 108. The finger portion 103 and palm portion 102 together form a pocket 105. Furthermore, the heel 108 extends across a lower portion 109 of the palm 102 to a lower portion 107 of the thumb 106. The thumb 106 is separated from the palm 102 such that a V-shaped gap 114 exists between the forefinger portion 123 of the palm 102 and an inner periphery 116 of the thumb 106. In particular, the V-shaped gap 114 is widest a ween the fingertip $\mathbf{112}_1$ of the forefinger portion 123 and an uppermost portion (i.e., thumb tip) 118 of the thumb 106. Additionally, a crotch area 110 connects the lower portion 107 of the thumb 106 to the palm 102 above the heel 108, such that the heel portion 108, palm portion 102, and crotch 110 are coextensive to each other. In particular, the thumb portion 106 and palm 102 are connected at the crotch 110, which is below the "V" of the V-shaped gap 114. As such, the finger portion 103, palm portion 102, heel portion 108, crotch 110, and thumb portion 106 are preferably one unitary sheet of leather.

Disposed in the V-shaped gap 114 between an outer edge 124 of the forefinger 123 and inner periphery 116 of the thumb 106 is the web 104. The web 104 illustratively comprises one or more strips of leather and lace (e.g., leather lace) to form a flexible mesh-like web or trap. The web 104 is constructed to provide a relatively high level of energy absorption and retain the ball. More specifically, the web 114 comprises a first strap 130 spanning between the outer edge 124 of the forefinger 123 and inner periphery 116 of the thumb 106. A second strap 132 is attached (e.g., stitched) perpendicular to the first strap 130 approximately bisecting the first strap 130 and extends down to the crotch 110 in the form of a "T". The first and second straps 130 and 132 are attached through a plurality of holes 126 disposed in the forefinger 123 and inner periphery 116 of the thumb 106 via stitching or preferably by lacing 128. The lacing 128 extends through a plurality of holes 131 on either side of the bisecting strap 132 to the inner periphery 116 of the thumb 106 and forefinger 123 such that the lacing 128 and straps 130 and 132 together form the web 104. A person skilled in the art will recognize that the web 104 may be formed by various arrangements of one or more straps, strips, or sheets of material (e.g., leather) and lacing, which together is capable of trapping a baseball.

Since the web 104 is flexible, the web 104 will deform upon impact of a baseball and conform partially around the ball to secure the ball therein. Furthermore, the web 104 and pocket 105 (i.e., finger portion 103 and palm portion 102) together form a glove "basket", where the web 104 is the central and deepest part of the glove basket. As such, the web 104 is primarily intended to secure "fly-balls" and line drives that are hit or thrown to the fielder, while the pocket portion 105 is primarily intended to field ground balls as discussed below.

Referring to FIG. 2, the back shell 202 is a single ply disposed over the front shell 101 such that the two shells 101 and 202 are coupled together about their respective peripheral edges 120 and 204. In particular, the front shell 101 and back shell 202 are stitched and/or laced together about the peripheral edges 120 and 204, except for an opening 212 extending proximate a lower portion 122 of the heel 108 of the front shell 101. Optionally, the peripheral edges 120 and 204 are individually bound with a binding (e.g., leather) to prevent fraying. The front and back shells 101 and 202 are attached to each other with a thread like material such as nylon thread and/or leather lace 206. The opening 212 permits the hand of the fielder to be inserted into the mitt 100 between the first and second shells 101 and 202.

Additionally, a wrist strap 210 extends over a portion of the opening 212 such that an aperture 208 is defined above the wrist strap 210 in the back shell 202, thereby exposing the knuckles of the fielder's hand. The inner surface of the wrist strap 210 may be lined with a soft protective lining (not shown) such as cloth, artificial fur, lambs wool, or any other soft material that affords comfort and protection from rubbing the wrist and backside of the fielder's hand against the inside of the wrist strap 210 during use.

Optionally, a forefinger port 214 is provided over the forefinger portion 123 of the back shell 202 to permit the infielder to traverse their forefinger though the forefinger port 214. In this manner, the infielder may utilize the back shell 202 as an additional layer of padding between the ball and the infielder's forefinger.

Figure 4:
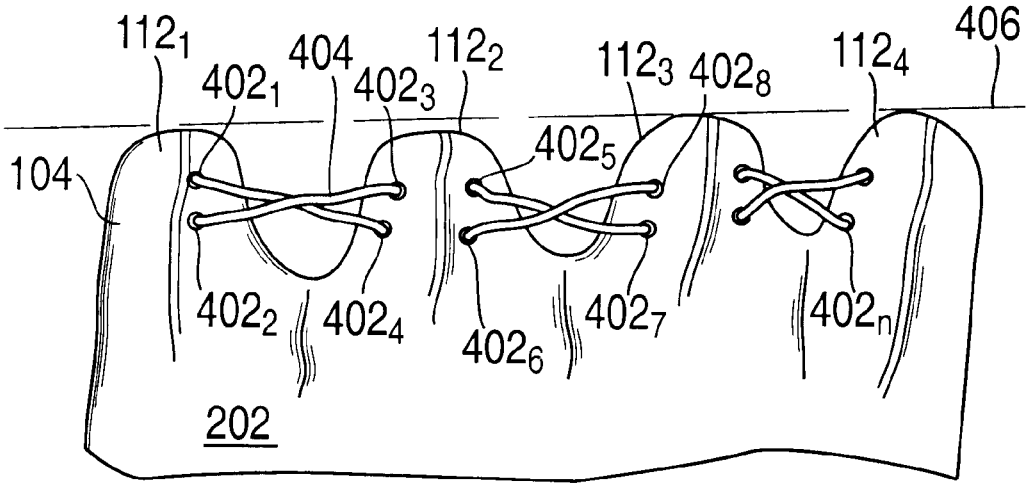
FIG. 4 depicts a detailed rear view of a plurality of fingertips of FIG. 2.

FIG. 4 depicts a detailed rear view of the fingertips 112 of FIG. 2. The fingertips 112 are formed above the planar finger portion 103 of the mitt 100. Specifically, a forefinger tip $\mathbf{112}_1$, middle fingertip $\mathbf{112}_2$, ring fingertip $\mathbf{112}_3$, and little fingertip $\mathbf{112}_4$ each extend above the planar finger portion 103. Each fingertip 112 terminates at a commonly defined linear axis 406 such that the four fingertips $\mathbf{112}_1$ through $\mathbf{112}_4$ are aligned, as opposed to a conventional glove where the uppermost edges of the fingertips (e.g. the little fingertip) do not terminate at a common linear axis and therefore are not aligned with one another. In one embodiment, the fingertips 112 have a height of approximately 1 inch. Each fingertip 112 is also respectively aligned with the fielder's fingers and finger stalls (not shown) as discussed below.

Furthermore, each fingertip 112 is laced to the adjacent fingertip through the back shell 202. In particular, a plurality of holes $\mathbf{402}_n$, is disposed along the backsides of each fingertip 112 on the back shell 202. In one embodiment, the forefinger tip $\mathbf{112}_1$ illustratively has a pair of holes $\mathbf{402}_1$ and $\mathbf{402}_2$, disposed in the back shell 202, and adjacent to a second pair of holes $\mathbf{402}_3$ and $\mathbf{402}_4$ disposed in the middle fingertip $\mathbf{112}_2$. Likewise, a third pair of holes $\mathbf{402}_5$ and $\mathbf{402}_6$ are disposed in the middle finger tip $\mathbf{112}_2$ adjacent to a fourth pair of holes $\mathbf{402}_7$ and $\mathbf{402}_8$ disposed in the ring fingertip $\mathbf{112}_3$, and so on, such that each fingertip 112 is attached to the adjacent fingertip. A lace 404 such as leather lacing is strung through the adjacent pairs of holes 402 on the back shell 202 between the fingertips 112. As such, the lacing 404 between the fingertips 112 does not interface with the front shell 101 and accordingly, does not interfere when a fielder fields a ground ball with the palm 102 of the mitt 100. Furthermore, the lacing 404 may be tightened to effectively pull the fingertips 112 and planar finger portion 103 straight or backwards, thereby preventing the fingertips 112 and planar finger portion 104 from curling inward.

Figure 3:
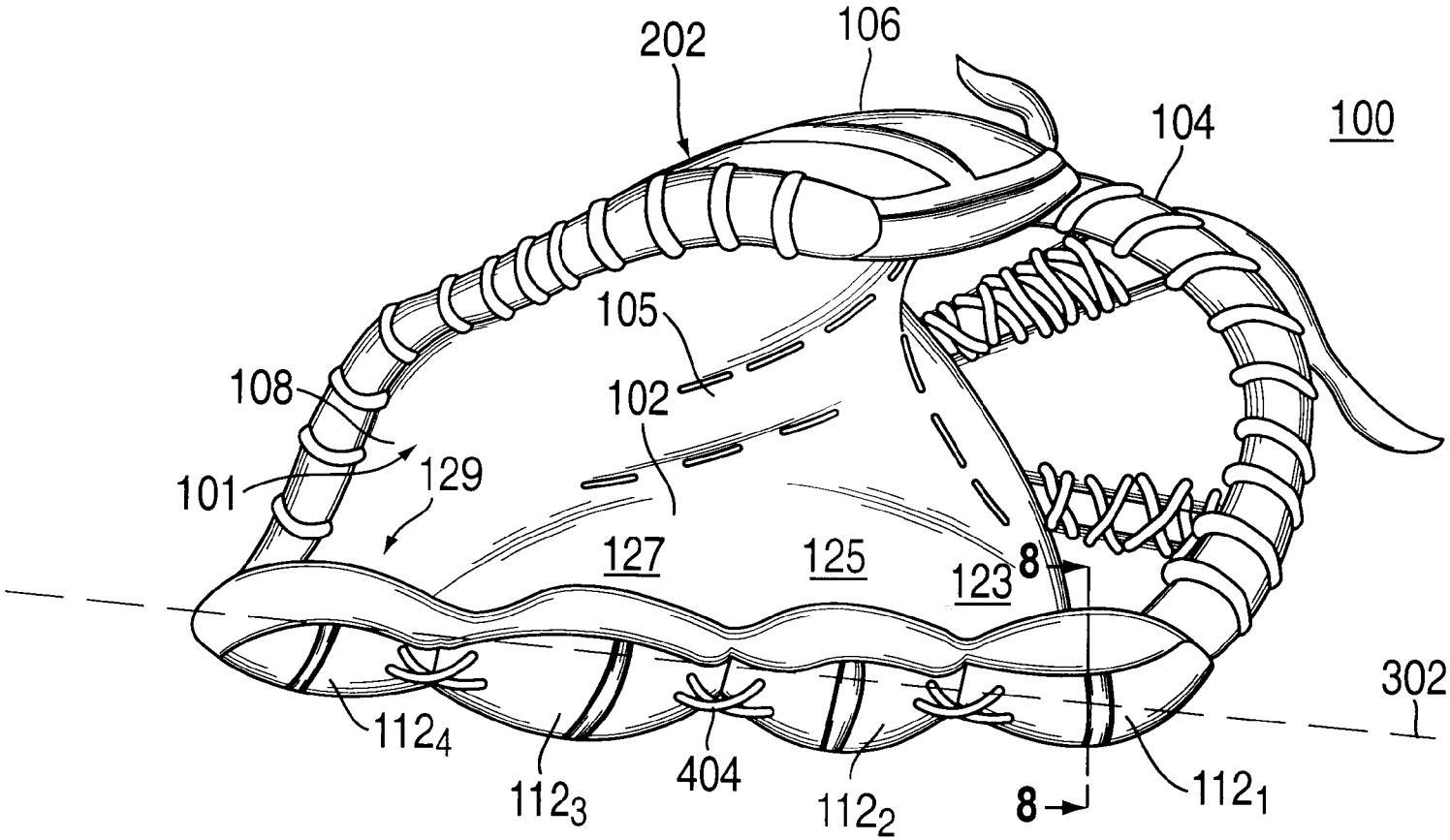
FIG. 3 depicts a top view of the fielder's mitt of FIG. 1.

FIG. 3 depicts a top view of the fielder's mitt 100 of FIG. 1. In particular, FIG. 3 depicts the mitt 100 with the mitt 100 in an opened position. Specifically, the planar finger portion 103 is flat such that the fingertips 112 are substantially aligned along an axis 302. Therefore, only a minimal degree of curvature exists between the forefinger tip $\mathbf{112}_1$ and little fingertip $\mathbf{112}_4$. In particular, the planar finger portion 103 of the front shell 101 is a single ply (e.g., leather) as opposed to being formed from separate individual fingers having various contours and height differentials across the surface of the fingers. Accordingly, a fielded ground ball does not rattle around the planar finger portion 103 upon impact, as it does with a conventional glove having four independent fingers disposed over the palm area.

In addition, the flat surface area of the planar finger portion 103 and axially aligned fingertips 112 provide a greater surface area for fielding ground balls (e.g., scooping the ball), as opposed to conventional gloves, which exhibit an arc or curvature between the forefinger portion 123 and the little finger portion 129. Accordingly, when the fielder lowers the mitt 100 to field a ground ball, the surface area of the planar finger portion 103 (which is the preferred area to field ground ball) is maximized to provide improved ball stopping capabilities. As a consequence, the infielder does not have to rely on the web portion 104 of the mitt 100 to trap the ground ball. Accordingly, the fielder does not have to reach into and search the web 104 for the ball, thereby losing precious seconds. Instead, the ball is stopped in the planar finger portion 103 and palm portion 102, thereby allowing the fielder's throwing hand to quickly retrieve the ball from the mitt 100.

Figure 5:
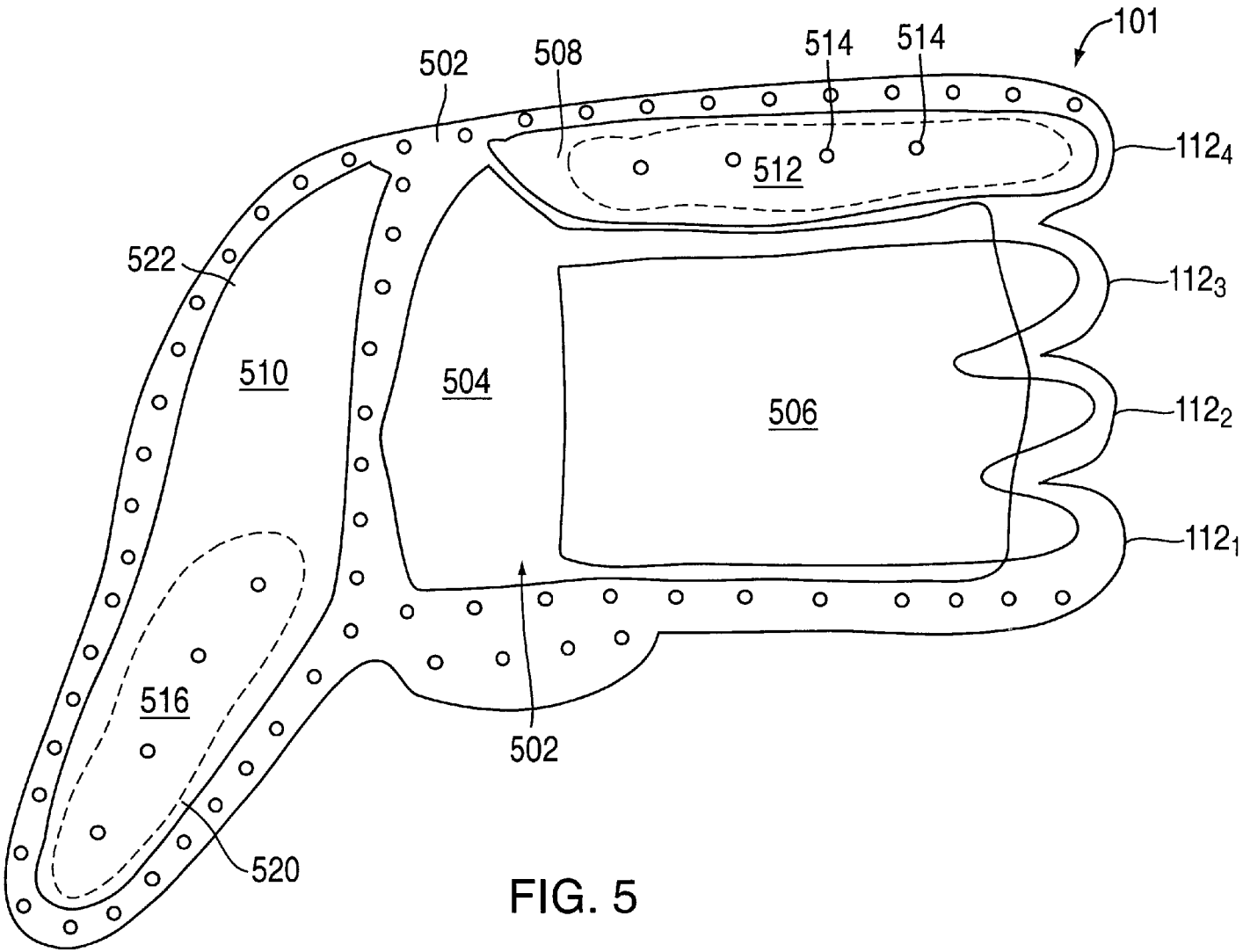
FIG. 5 depicts a top view of an inner surface of the front shell 101 having an arrangement of padding thereon.

FIG. 5 depicts a top view of an inner surface of the front shell 101 having an arrangement of padding thereon. The planar finger portion 103 and axially aligned fingertips 112 permanently maintain their flat surface area by utilizing layers of padding, which is disposed at various positions between the front shell 101 and back shell 202 (i.e., interior) of the mitt 100. FIG. 5 depicts one arrangement of padding disposed over an inner surface 502 of the front shell 101 prior to disposing and attaching the back shell 202 to the front shell 101.

In particular, a first palm layer 504 is disposed over the planar finger portion 103 and is dimensioned to cover the first three finger portions 123, 125, and 127, up to their respective fingertips $\mathbf{112}_1$ through $\mathbf{112}_3$. The first layer 504 is preferably fabricated from a soft, pliable, lightweight material (e.g., leather) and is fastened (e.g., glued) to the inner surface 502 of the front shell 101. A person skilled in the art will recognize that other soft, pliable, lightweight materials may be used to fabricate the first palm layer 504 such as plastic, and the like, and that the first palm layer 504 may be fastened to the inner surface 502 of the front shell 101 by stitching and the like.

A three-finger padding layer 506 is disposed over the first palm layer 504 and is sized to cover the first palm layer 504 and the first three fingertips $\mathbf{112}_1$ through $\mathbf{112}_3$. The three-finger padding layer 506 is fabricated from a soft padding material capable of quickly compressing and decompressing such as foam, fiber, and the like. Upon impact from the baseball, the three-finger padding layer 506 will compress to absorb energy from the ball and stop the ball in the planar finger portion 103 of the mitt 100. Preferably, the three-finger padding layer 506 is fabricated from a fibrous felt-like material having a thickness of approximately ¼ to ⅜ of an inch. After impact, the three-finger padding layer 506 expands back to the original thickness. The three-finger padding layer 506 is not fixedly attached to the first palm layer 504 or inner surface 502 of the front shell 101. Rather, the three finger padding layer 506 is fixedly attached to an intermediate shell (not shown) as discussed with regard to FIG. 6 below.

FIG. 5 further depicts a little finger padding layer 508 disposed over the little finger portion 129 of the mitt 100. In particular, the little finger padding layer 508 extends from above the heel 108 through the little fingertip $\mathbf{112}_4$. The little finger padding layer 508 is fabricated from similar materials as the three-finger padding layer 506 and preferably has a thickness of approximately ½ to ⅝ of an inch. Furthermore, a first stiffening layer 512 (drawn in phantom) is disposed within the little finger padding layer 508 to limit the flexibility of the little finger portion 129 of the mitt 100.

In particular, the first stiffening layer 512 is flexible enough to allow the fielder to bend the little finger portion 129 of the planar finger portion 103 by exerting an external force, illustratively from the impact of a baseball. However, the first stiffening layer 512 will return to its normal position once the external forces are removed there from. The first stiffening layer 512 may be fabricated from a plastic material, and one skilled in the art will recognize that the flexibility of the first stiffening layer 512 is dependent on the fabrication materials and respective thickness. The little finger padding layer 508 and corresponding first stiffening 512 are attached to the inner surface 502 of the front shell 101 and back shell 202 via lacing (not shown). In particular the lacing traverses through a plurality of apertures 514 extending through the little finger padding 508 and aligned with corresponding holes (not shown) in both the front and back shells 101 and 202.

In addition, a lower padding layer 510 comprising a thumb portion 520 and heel portion 522 is disposed over the thumb 106 and heel 108 portions of the front shell 101. In one embodiment, the lower padding layer 510 is approximately ½ to ⅝ of an inch in thickness. Furthermore, a second stiffening layer 516 (drawn in phantom) is disposed within the thumb portion 520 of the lower padding layer 510. The lower stiffening layer is fabricated from similar materials as the first stiffening layer 512 and serves to retain the thumb 106 in a relatively straight position with minimal flexibility.

Figure 6:
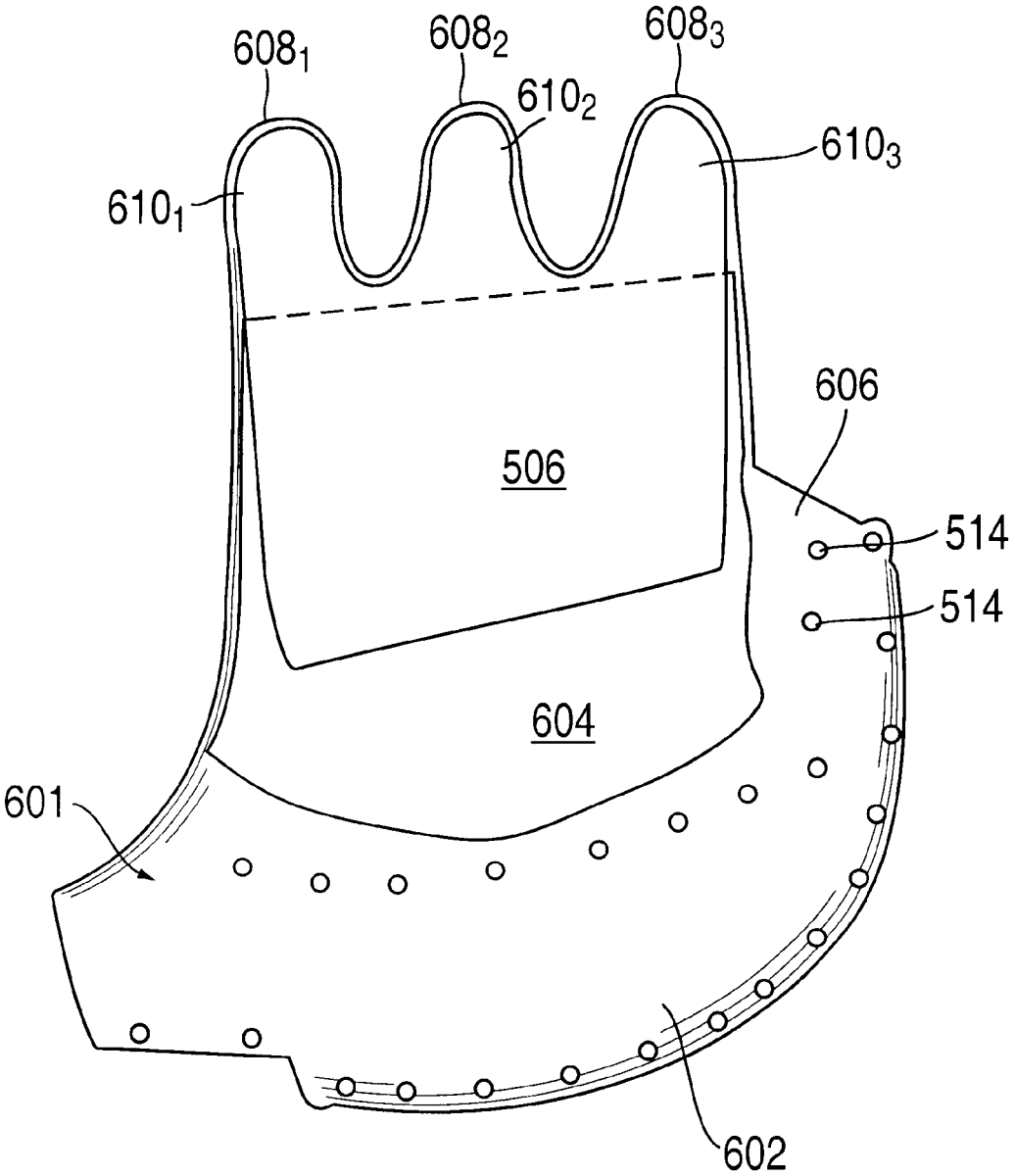
FIG. 6 depicts a bottom view of an intermediate shell disposed between a front shell and back shell of the mitt of FIG. 1.

FIG. 6 depicts a bottom view of an intermediate shell 602 disposed between a front shell 101 and back shell 202 of the mitt 100 of FIG. 1. In particular, FIG. 6 depicts a lower surface 601 of the intermediate shell 602, which faces the inner surface 502 of the front shell 101. The intermediate shell 602 is shaped to cover the palm portion 102, heel 108, first three finger portions 123, 125, and 127, and their respective fingertips $\mathbf{112}_1$, $\mathbf{112}_2$, $\mathbf{112}_3$, as well as a lower portion 606 of the little finger portion 129. Accordingly, the intermediate shell 602 comprises three fingertip sections $\mathbf{608}_1$, $\mathbf{608}_2$, and $\mathbf{608}_3$.

A second palm layer 604 having a substantially mirror image shape as the first palm layer 504 is attached to the lower surface 601 of the intermediate shell 602. The second palm layer 604 is fabricated from similar materials, and attached in the same manner as described above for the first palm layer 504. As such, the second palm layer 604 is preferably fabricated from leather and then glued directly to the intermediate shell 602.

Furthermore, the three-finger padding layer 506 is attached to the second palm layer 604. The three-finger padding layer 506 further comprises three fingertip sections $\mathbf{610}_1$, $\mathbf{610}_2$, and $\mathbf{610}_3$, which cover the three fingertip sections $\mathbf{608}_1$, $\mathbf{608}_2$, and $\mathbf{608}_3$ of the intermediate shell 602. In one embodiment, the three-finger padding layer 506 is stitched to the second palm layer 604 and intermediate layer 602 by stitching the three fingertip sections $\mathbf{610}_1$, $\mathbf{610}_2$, and $\mathbf{610}_3$ of the three-finger padding layer 506 to the three fingertip sections $\mathbf{608}_1$, $\mathbf{608}_2$, and $\mathbf{608}_3$ of the intermediate shell 602. One skilled in the art will recognize that the second palm layer 604 and the three-finger padding layer 506 may be attached to the intermediate shell 602 by any other fastening technique that permanently holds such mitt components in their respective positions.

Figure 7:
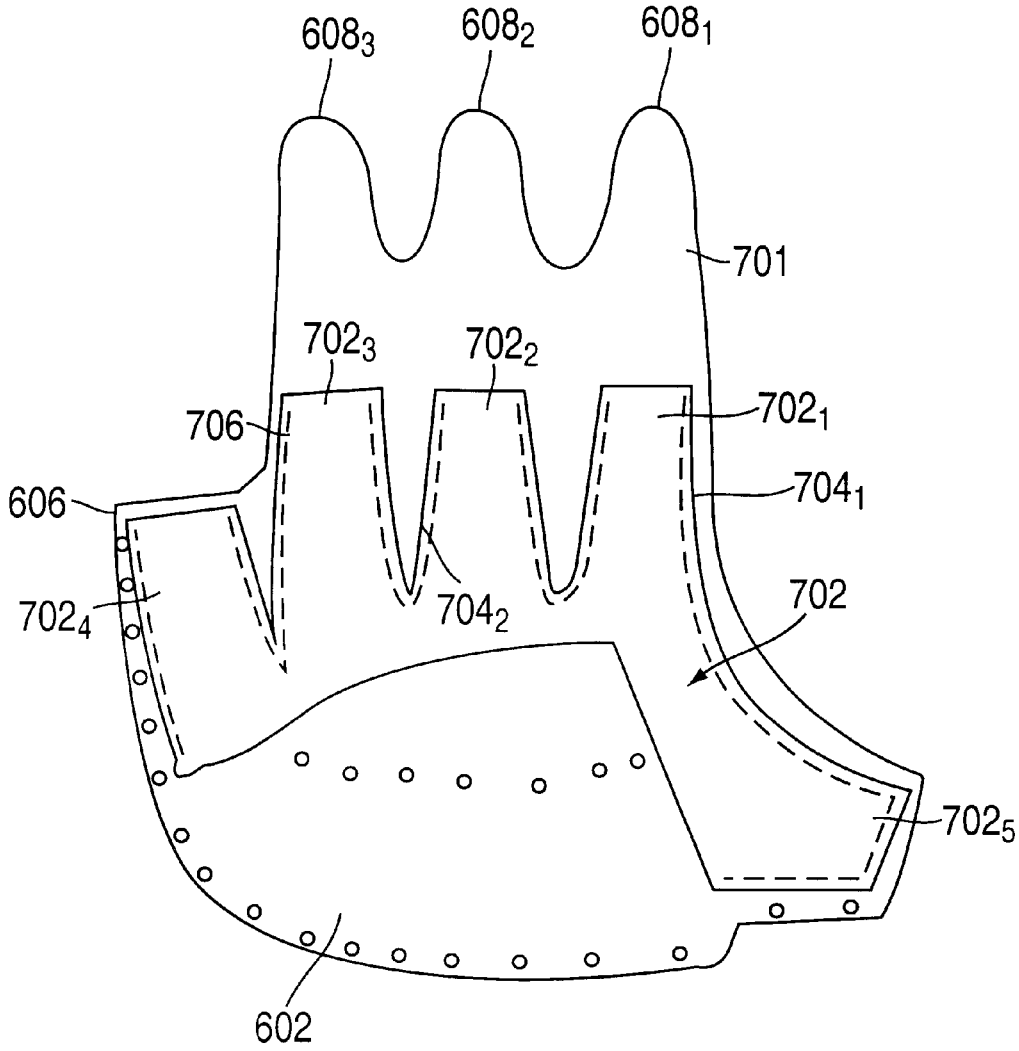
FIG. 7 depicts a top view of the intermediate shell having a plurality of finger stalls of FIG. 6.

FIG. 7 depicts a top view of the intermediate shell 602 having a plurality of finger stalls 702. In particular, FIG. 7 depicts an upper surface 701 of the intermediate shell 602. The plurality of finger stalls $\mathbf{702}_1$ through $\mathbf{702}_5$ are attached to the upper surface 701 to retain the fielders fingers therebetween the finger stalls 702 and upper surface 701 of the intermediate shell 602. The finger stalls 702 are fabricated from a soft flexible material such as leather, cloth, and the like.

Each finger stall 702 comprises enough material to cover the top and sides of an infielder's finger and also be attached to the upper surface 701 of the intermediate shell 602. Each finger stall 702 is stitched with a thread like material 706 (e.g., nylon), along the length of the finger stalls 702 where the finger stall material interfaces with the upper surface 701, as shown for example at $\mathbf{704}_1$ and $\mathbf{704}_2$. As such, the finger stalls 702 and upper surface 701 beneath the finger stalls 702 form a substantially tubular covering for receiving and retaining the fingers in the mitt 100.

Figure 8:
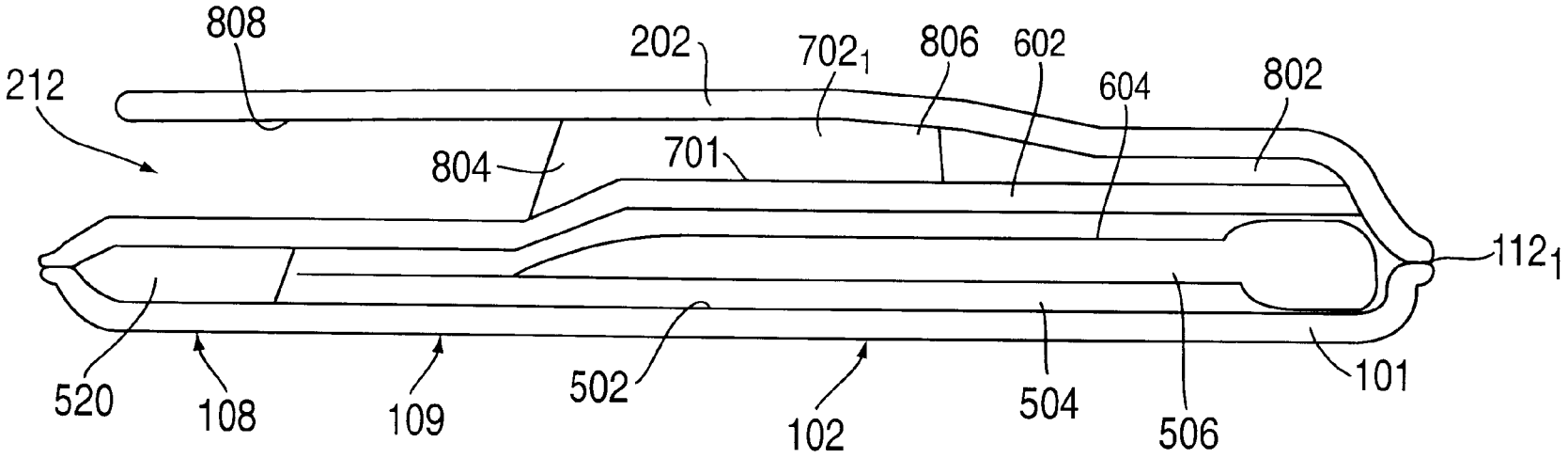
FIG. 8 depicts a cross-sectional view of the mitt layers and padding taken along line 8—8 of FIG. 3.

FIG. 8 depicts a cross-sectional view of the mitt layers and padding taken along line 8—8 of FIG. 3. For sake of clarity, FIG. 8 illustratively depicts a cross-sectional view across the palm portion 102, planar finger portion 103, and forefinger tip $\mathbf{112}_1$ proximate the web 104. For further understanding, FIG. 8 represents the cross-sectional view of the mitt 100 as taken when the mitt components of FIGS. 5, 6, and 7 are respectively disposed over each other.

Referring to FIGS. 5 through 7, in conjunction with FIG. 8, the front shell 101 is represented by the bottom layer having the first palm layer 504 disposed upon the inner surface 502 of the front shell 101 as depicted in FIG. 5. The first palm layer 504 extends from above the heel 108 over the palm portion 102 and planar finger portion 103, and terminates at the fingertips 112 (e.g., forefinger tip $\mathbf{112}_1$). Disposed over the heel portion 108 of the inner surface 502 of the front shell 101 is the lower padding layer 510 (e.g., the thumb portion 520 of the second padding layer 510).

Disposed above the first palm layer 504 is the three-finger padding layer 506, which preferably extends from above the palm portion 102, and over the planar finger portion 103, and through the fingertips 112 of the first three fingers $\mathbf{112}_1$, $\mathbf{112}_2$, and $\mathbf{112}_3$. On top of the three-finger padding layer 506 is the second palm layer 604, which extends from above the heel 108 and terminates below the fingertips 112 (e.g., forefinger tip $\mathbf{112}_1$), in a similar manner as the first palm layer 504.

The intermediate shell 602 is disposed over the second palm layer 604, as well as the exposed portion of the three-finger padding layer 506 positioned in the fingertips (e.g., fingertip $\mathbf{112}_1$). Moreover, the intermediate shell 602 extends over the second and first palm layers 604 and 504, as well as the lower padding layer 510, and is then attached to the inner surface 502 of the front shell 101 via stitching and/or lace (not shown).

The finger stalls 702, for example finger stall $\mathbf{702}_1$ in FIG. 8, is stitched to the upper surface 701 of the intermediate shell 602 as described above. A first end 804 of each finger stall (e.g., finger stall $\mathbf{702}_1$) lies proximate where the palm and fingers of a fielder's hand join, such that the fingers of the fielder's hand is primarily positioned over three-finger padding layer 506. The finger stalls 702 have a length approximating the length of a typical finger of a fielder and terminate at a second end 806. Each finger stall 702 is positioned on the intermediate shell 602 such that the three-finger padding layer 506 is below the finger stalls 702.

As such, the fielder's palm is only covered by the front shell 101, the first and second palm layers 504 and 604, and the intermediate shell 602, thereby permitting greater mobility for the fielder to open and close their hand and mitt 100. The mitt 100 is designed to flex at the palm portion 102 so that the mitt 100 can open and close. Specifically, the planar finger portion 103 and respective fingertips 112 of the mitt 100 are drawn towards the thumb 106 in the closed position, and away from the thumb 106 in the open position.

Disposed over the intermediate shell 602 and finger stalls 702 is the back shell 202. The back shell 202 is stitched and/or laced to the front shell 101 at the fingertips 112 as discussed with regard to FIGS. 1 and 2. The back shell 202 lies over the finger stalls 702 and intermediate shell 602 such that an air pocket 802 is defined. The air pocket 802 extends from the forefinger portion 123 to the little finger portion 129 (i.e., planar finger portion 103), and from the second end 806 of the finger stalls 702 to the fingertips 112 (e.g., finger stall $\mathbf{702}_1$ and fingertip $\mathbf{112}_1$) . The air pocket 802 provides additional space for the fielder's fingers to fit in the mitt 100.

Furthermore, the air pocket 802 provides a channel for airflow, such that when the ball impacts the planar finger portion 103, the air therein is easily pushed through the finger stalls 702 and out of the mitt 100. In this manner, the ball will not bounce off the planar finger portion 103 upon impact. Rather, the ball will "stick" to the planar finger portion 103. Specifically, as the three-finger padding 506 compresses against the intermediate shell 602, the intermediate shell 602 is pushed back towards the inner surface 808 of the back shell 202. Consequently, the air pocket 802 collapses and forces the air stored therein through all the finger stalls 702 and out of the mitt 100.

Accordingly, the mitt 100 having the air pocket 802 is distinguished from a conventional glove, which is limited to having air forced from the glove only from the individual fingers that are impacted. For example, upon impact, the contours and height differences between each of the fingers are amplified, thereby increasing the likelihood that the ball will bounce off the fingers of the glove. Therefore, in addition to the three-finger padding layer 506 of the mitt 100, the air pocket 802 also serves to absorb the energy from the impact of the ball, and thereby increases the time that a fielded ball remains on the planar finger portion 103 of the mitt 100.

In addition, FIG. 8 also depicts the opening 212 at the opposite end of the fingertips 112 and between the intermediate shell 602 and inner surface 808 of the back shell. The opening 212 permits the fielder's hand to be inserted into and removed from the mitt 100, as discussed with regard to FIG. 2.

The layers and padding of the mitt 100 define a planar finger portion 103 that is flat, as opposed to the conventional curved glove where the little finger arcs towards the thumb. Referring to FIG. 3, the four fingertips $\mathbf{112}_1$ through $\mathbf{112}_4$ and the planar finger portion 103 together form a "dustpan" shaped pocket 105. In particular, the dustpan pocket 105 is maintained along the axis 302 when the fielder positions the mitt 100 along the ground. As such, the fielder is provided with an increased surface area for fielding a ground ball. Moreover, the infielder no longer has a need to bend the fingertips 112 backwards in an attempt to flatten the planar finger portion 103 and fingertips 112 of the mitt 100, since the mitt 100 is deliberately formed with such dustpan shaped pocket 105.

Additionally, the little finger padding layer 508, which is disposed over the little finger portion 129 of the mitt 100 is thicker than the three-finger padding layer 506. As such, the little finger portion 129 of the palm 102 on the front shell 101 is slightly higher than the remaining finger portions 123, 125, and 127 of the mitt 100. In particular, the height of the little finger portion 129 is approximately ⅛ to ¼ of an inch higher than the other three finger portions 123, 125, and 127. Accordingly, once a grounded ball strikes the planar finger portion 103 of the mitt 100, the ball is subsequently channeled over the three finger portions 123, 125, and 127, between the little finger portion 129 and the web 104. This channeling effect serves to funnel the ball to the palm portion 102 of the mitt 100, as opposed to being trapped in the web 104, thereby making it easier for the infielder to grasp the ball with the throwing hand. Thus, the infielder does not have to reach into the deepest part of the mitt 100 (i.e., the web 104) to retrieve the ball.

Furthermore, when the ball impacts the front shell 101 over the three-finger padding layer 506, the three-finger padding layer 506 easily compresses such that the fielded ground ball will "stick" to the front shell 101 with minimal repulsion from the surface of the front shell 101. Moreover, the front shell 101 is a unitary single ply, which provides a surface for impact by the ball, as opposed to having independent fingers that exhibit a non-uniform surface area. In addition, the outer surface of the front shell 101 may be dimpled (not shown) to minimize any "spin" that exits on the ball, thereby improving the ball retaining capabilities of the mitt 100.

Although the teachings of the present invention that have been shown and described in detail herein, those skilled in the art can readily devise other varied embodiments that still incorporate the teachings and do not depart from the spirit of the invention.

What is claimed is:

1. A baseball mitt comprising:

a front shell having a planar finger portion terminating with four extended fingertips, a palm portion positioned below and coextensive with the planar finger portion, a thumb portion extending from said palm portion and adjacent to the planar finger portion, and a heel portion positioned below and coextensive with the palm portion and the thumb portion;

a web disposed between the thumb portion and the planar finger portion; and a back shell attached about a peripheral edge of the front shell.

2. The mitt of claim 1 wherein the planar finger portion is substantially flat.

3. The mitt of claim 1 wherein the planar finger portion comprises a forefinger portion, a middle finger portion, a ring finger portion, and a little finger portion.

4. The mitt of claim 3 wherein the forefinger portion, the middle finger portion, the ring finger portion, and the little finger portion are substantially axially aligned.

5. The mitt of claim 4 further comprising an intermediate shell disposed between the front shell and the back shell.

6. The mitt of claim 5 wherein the planar finger portion further comprises at least one padding layer disposed between the intermediate shell and the front shell, proximate said forefinger portion, middle finger portion, and little finger portion.

7. The mitt of claim 6 wherein the at least one padding layer is compressible.

8. The mitt of claim 6 wherein said planar finger portion further comprises a little finger padding layer disposed between the intermediate shell and the front shell, proximate said little finger portion.

9. The mitt of claim 8 wherein the little finger padding layer further comprises a stiffening layer disposed therein.

10. The mitt of claim 9 wherein the stiffening layer is fabricated from a semi-flexible plastic.

11. The mitt of claim 9 wherein the little finger padding layer has a thickness greater than the at least one padding layer disposed proximate the forefinger portion, middle finger portion, and little finger portion.

12. The mitt of claim 11 wherein the heel portion further comprises a heel padding layer disposed between the intermediate shell and the front shell.

13. The mitt of claim 12 wherein the thumb portion further comprises a thumb padding layer disposed between the intermediate shell and the front shell.

14. The mitt of claim 13 wherein the thumb padding layer further comprises a stiffening layer disposed therein.

15. The mitt of claim 14 wherein the stiffening layer is fabricated from a semi-flexible plastic.

16. The mitt of claim 5 wherein an air pocket is formed between said intermediate shell and said back shell.

17. The mitt of claim 16 wherein the air pocket provides a channel for airflow, such that upon impact to the planar finger portion, air stored in said air pocket is forced out of the mitt.

18. The mitt of claim 3 wherein the forefinger portion, the middle finger portion, the ring finger portion, and the little finger portion terminate at a common linear axis.

19. The mitt of claim 1 wherein the fingertips are laced through the back shell.

20. The mitt of claim 19 wherein the fingertips are pulled back by the lace through the back shell.

* * * * *

UNITED STATES PATENT AND TRADEMARK OFFICE

CERTIFICATE OF CORRECTION

PATENT NO. : 6,353,931 B1 
DATED : March 12, 2002
INVENTOR(S) : Gilligan et al.

It is certified that error appears in the above-identified patent and that said Letters Patent is hereby corrected as shown below:

Column 10,
Lines 14 and 27, “little” should be -- ring --.

Signed and Sealed this

Eighth Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,353,931 B1
DATED : March 12, 2002
INVENTOR(S) : Gilligan et al.

It is certified that error appears in the above-identified patent and that said Letters Patent is hereby corrected as shown below:

Column 10,
Lines 14 and 29, “little” should be -- ring --.

This certificate supersedes Certificate of Correction issued July 8, 2003.

Signed and Sealed this

Nineteenth Day of August, 2003

JAMES E. ROGAN
*Director of the United States Patent and Trademark Office*